United States Patent [19]

Lewis

[11] Patent Number: 4,670,113

[45] Date of Patent: Jun. 2, 1987

[54] ELECTROCHEMICAL ACTIVATION OF CHEMICAL REACTIONS

[76] Inventor: Arlin C. Lewis, P.O. Box AU, Libby, Mont. 59923

[21] Appl. No.: 788,148

[22] Filed: Oct. 16, 1985

Related U.S. Application Data

[63] Continuation-in-part of Ser. No. 666,542, Oct. 30, 1984, abandoned.

[51] Int. Cl.[4] ..... C25B 1/00

[52] U.S. Cl. ..... 204/80; 204/129; 204/101; 423/415 A

[58] Field of Search ..... 204/129, 101, 80; 423/415 A

[56] References Cited

U.S. PATENT DOCUMENTS

| | | | |
|---|---|---|---|
| 4,158,637 | 6/1979 | Jones | 208/449 R |
| 4,171,247 | 10/1979 | Harang et al. | 204/34 |
| 4,184,931 | 1/1980 | Inoue | 204/129 |
| 4,226,683 | 10/1980 | Vaseen | 204/101 |
| 4,268,363 | 5/1981 | Coughlin | 204/39 |
| 4,279,710 | 7/1981 | Coughlin | 204/101 |
| 4,302,320 | 11/1981 | Lewis | 204/278 |
| 4,341,608 | 7/1982 | St. John | 204/129 |
| 4,389,288 | 7/1983 | Vaughan | 204/101 |
| 4,412,893 | 11/1983 | Fray et al. | 204/105 R |
| 4,425,203 | 1/1984 | Gray | 204/129 |
| 4,555,317 | 11/1985 | Nicolas | 204/129 |

FOREIGN PATENT DOCUMENTS

| | | | |
|---|---|---|---|
| 57-192274 | 11/1982 | Japan | 204/129 |

*Primary Examiner*—R. L. Andrews

*Attorney, Agent, or Firm*—Bacon & Thomas

[57] ABSTRACT

A process for the gasification or combined gasification and liquefaction of carbon or carbonaceous materials by utilizing electrochemically generated atomic hydrogen to activate the chemical reaction between the ions of dissociated water and the carbon or carbonaceous material in an electrolysis cell, thereby producing gaseous or combined gaseous and liquid products in amounts exceeding the Faraday equivalents of such products for the amount of electrical energy consumed.

28 Claims, 4 Drawing Figures

ELECTROCHEMICAL ACTIVATION OF CHEMICAL REACTIONS

CROSS REFERENCE TO RELATED APPLICATION

This application is a continuation-in-part of application Ser. No. 06/666,542, filed on Oct. 30, 1984, now abandoned.

BACKGROUND OF THE INVENTION

1. Field of the Invention

The present invention generally involves the field of technology relating to chemical reactions known as oxidation-reduction reactions. More particularly, the invention relates to the activation of such reactions by electrochemically generated atomic hydrogen.

2. Description of the Prior Art

It is known to electrochemically generate hydrogen and either carbon dioxide or carbon monoxide gases through an oxidation-reduction reaction. This may be accomplished in an electrolytic cell environment by anodic oxidation of carbon and cathodic reduction of hydrogen ion in an aqueous acidic electrolyte. In this process, the anode is consummable and formed of an appropriate carbonaceous material, such as coal, lignite, active carbons, coke and the like. The cathode is not consummable and formed of copper, iron or other such suitable material. These electrodes are immersed in the aqueous acidic electrolyte contained within an electrolytic cell, wherein the latter is typically subdivided into separate anolyte and catholyte chambers by an ion permeable membrane or a porous barrier which prevents or minimizes mixing of the anolyte and catholyte portions of the electrolyte. When an electrical potential of sufficient voltage is applied across the electrodes from a direct current power source, oxidation of a carbonaceous anode produces oxides of carbon, and reduction of hydrogen ion at the cathode produces hydrogen.

It is also known that the aforedescribed electrochemical reaction may be catalyzed or otherwise improved through the addition of various agents to the electrolyte in order to affect the rate of oxidation of the carbonaceous material or to lower the half cell voltage required for oxidation to occur, thereby increasing the amount of current passed through the cell for a given operating voltage. Conventional electrochemical processes of this type have essentially been constrained to a strict adherence to Faraday's Law wherein, for a given amount of electrical current utilized to drive the reaction, a fixed maximum volume of gas can be generated when the operation is 100% efficient. This limitation has therefore rendered heretofore known techniques for the electrochemical gasification of carbonaceous materials impractical for the joint production of hydrogen and oxides of carbon. This is because, notwithstanding the utilization of catalyzed reactions, the volume of gas produced does not justify the cost of the electrical energy consumed.

In addition, the aforedescribed electrochemical reaction is a gasification reaction only. The objective of breaking the complex molecules present in coal, wood or other carbonaceous materials into desired liquid products useful in the chemical industry has not heretofore been realized electrochemically. A number of methods of coal liquefaction are available but are costly to operate and are therefore of questionable economic value. A low cost coal gasification and liquefaction process which can also be applied to other carbonaceous materials such as wood wastes, bagasse and other renewable resources would be a very useful addition to the chemical technology extant today.

It is well known that hydrogen electrochemically generated at a cathode is generated as H° (atomic hydrogen) by the combination of an electron ($e^-$) furnished by the cathode and a hydrogen ion ($H^+$) furnished by the electrolyte. Hydrogen gas ($H_2$) results from the combination of two units of atomic hydrogen to form the $H_2$ molecule. Since $H_2$ has limited solubility in aqueous electrolytes, it precipitates from solution to form $H_2$ bubbles which rise to the surface of the electrolyte and may be collected as hydrogen gas. It is also known that electrochemically generated atomic hydrogen is a powerful, though very transient, chemical agent. It is thought to be an important intermediate in the chemical reduction of chromic acid during chromium electroplating from chromic acid solutions. Attempts have been made to diffuse electrochemically generated atomic hydrogen through metal tubes or membranes to emerge at a metal-solution interface where it will provide a desired chemical reaction. In general, these and other efforts to gain physical control of atomic hydrogen and allow its efficient use in desired chemical reactions have been unsuccessful as compared to other methods of carrying on the reactions. Even chromium plating is an inefficient example of the use of atomic hydrogen as the operation is only 14% to 18% efficient in electrochemical energy use. Thus the long sought after method of utilizing the powerful chemical activity of atomic hydrogen in a wide variety of chemical reactions has not been heretofore realized.

SUMMARY OF THE INVENTION

It is the primary object of the present invention to provide a system employing electrochemical activation to cause desired chemical reactions to proceed in a manner so as to yield significantly greater quantities of chemical products than would conventionally be realized in the absence of such activation.

It is another object of the invention to provide a system for the production of hydrogen and carbon monoxide through electrochemical activation of the reaction of carbon and water.

It is a further object of the invention to provide a system for the hydrogenation or hydrogenation and partial oxidation of complex solid chemical components, such as those found in coal, wood or other such biomass, to convert them to gaseous and liquid chemical products.

It is yet another object of the invention to provide a system for the employment of electrochemical procedures to produce gaseous and liquid chemical products in volumes significantly exceeding those volumes which are conventionally realized for the same amount of electrical energy consumed.

It is still a further object of the invention to provide a system for the controlled employment of atomic hydrogen to activate and/or participate in chemical reactions.

These and other objects of the invention are realized through the reaction of various types of carbonaceous material in an electrolytic cell environment wherein a carbon-containing consummable anode and a metallic nonconsummable cathode are immersed in an aqueous acidic electrolyte. The space between the electrodes is devoid of any membrane or obstruction so as to permit free communication of reaction components throughout the electrolyte. The cell is preferably provided with an appropriate heat exchange means to remove excess heat generated during the electrochemical and chemical reactions.

The specific configurations and characteristics of the electrodes may vary and encompass conventional electrode structures that are well known in the art. When an electrical potential is applied to the cell, conventional electrochemical reactions are initiated at the anode and cathode. Thereafter, a chemical reaction occurs at the anode which yields quantities of both hydrogen and carbon containing products equal to or greater than the quantities produced by the electrochemical reactions. The rate of this chemical reaction may be significantly enhanced through the addition of an activator enhancement agent to the electrolyte, wherein such agent preferably includes a hydride-forming free metal or compound thereof. The cell configuration preferably includes sufficient free board space disposed above the electrolyte level to accommodate any foaming of the electrolyte produced by the active evolution of product gases. This foaming may be minimized by the addition of a defoaming agent to the electrolyte, thereby further increasing the amount of gas produced by minimizing gas polarization or gas masking of the carbonaceous reactant.

Further objects, features and attributes of the invention shall become apparent from the following detailed description thereof and appended claims, reference being made to the accompanying drawings forming a part of the specification, wherein the reference characters designate corresponding parts of the several views.

DETAILED DESCRIPTION OF THE PREFERRED EMBODIMENTS

Figure 1:
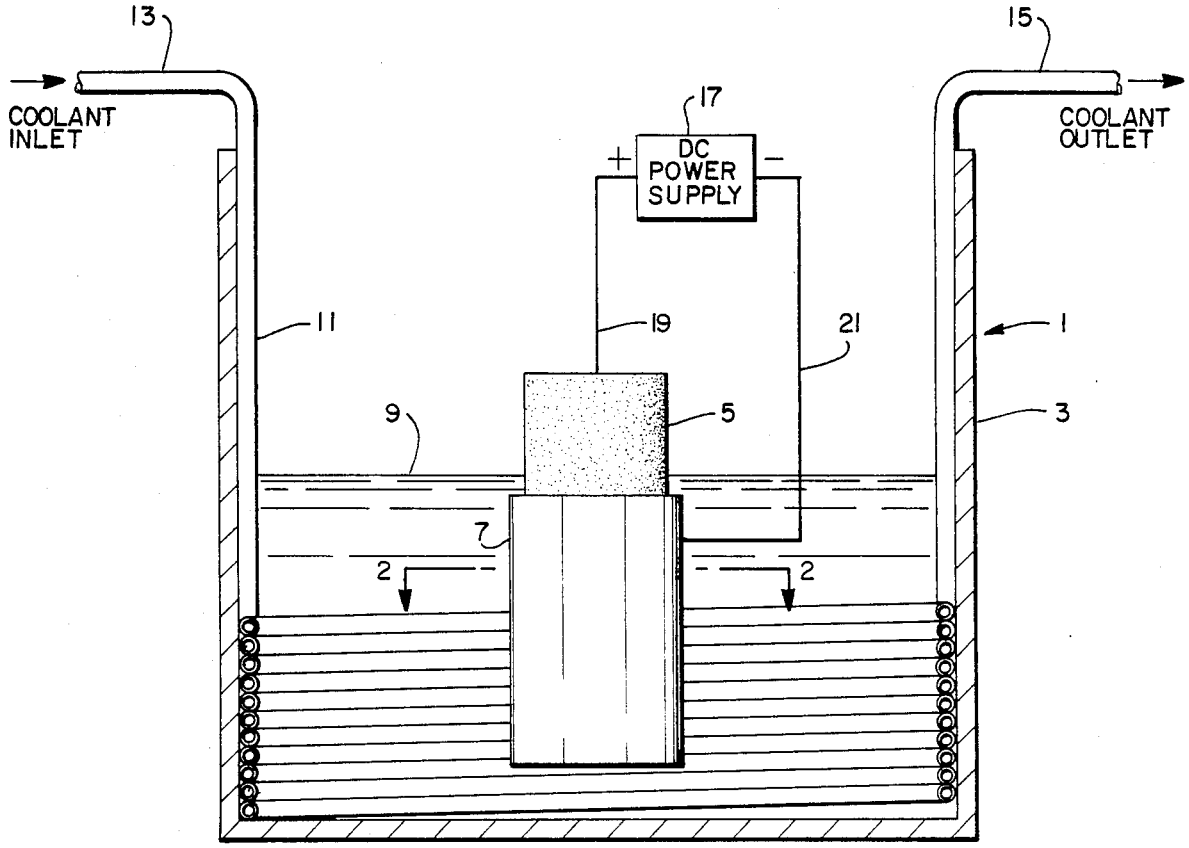
FIG. 1 is a schematic diagram of a preferred embodiment of an apparatus in the form of an electrolytic cell system which may be utilized in the practice of the invention to produce hydrogen, oxides of carbon and other gases from carbonaceous materials.

An electrolytic cell system 1 which may be used to practice a preferred embodiment of the invention shall now be described with reference to FIG. 1. System 1 includes a chamber within which an anode 5 and a cathode 7 are immersed in a volume of aqueous electrolyte 9. The height of chamber 3 should be such as to provide substantial freeboard space above the surface of electrolyte 9 for accommodating foam generated during the gasification and chemical reaction processes. Chamber 3 is also preferably provided with an appropriate heat exchange means such as a tubular coil 11 through which fluid coolant may be circulated from an inlet 13 to an outlet 15 for the purpose of removing heat generated during gasification and maintaining electrolyte 9 at an optimum process temperature. Electric potential is applied across anode 5 and cathode 7 by a suitable direct current power source 17 connected thereto through a pair of electrical conductors 19 and 21, respectively.

Figure 2:
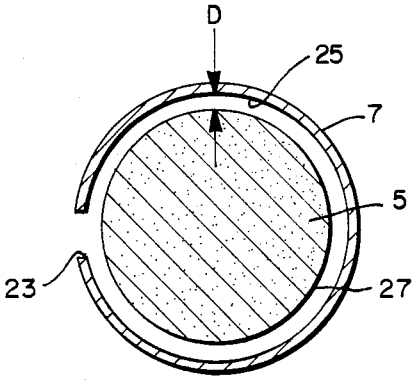
FIG. 2 is a cross-sectional view taken along the line 2—2 of FIG. 1.

The configuration of anode 5 and cathode 7, and their disposition with respect to each other shall now be described with reference to FIG. 2. As seen therein, anode 5 is of a solid cylindrical configuration, while cathode 7 is in the form of a tubular configuration and substantially entirely surrounds anode 5 and is spaced therefrom. Cathode 7 is provided with a longitudinal slot 23 which creates a fluid pumping action during gasification so that electrolyte may be continuously directed into the space between anode 5 and cathode 7. As is apparent in FIG. 2, cathode 7 includes an interior surface 25 that is spaced from an exterior surface 27 of anode 5 by a distance D. Since surfaces 25 and 27 are substantially the only exposed portions of the electrode surfaces disposed opposite each other, the application of an electrical potential across anode 5 and cathode 7 causes substantially the entire electrochemical gasification reaction to actively occur between surfaces 25 and 27, and the activated chemical reaction occurs at surface 27. The actual spacing of surface 25 from surface 27 is on the order of up to approximately one and one-half inches for distance D when an activator enhancement agent is used, though preferably within the range of approximately one-sixteenth to three-sixteenth inch either with or without an activator enhancement agent.

Figure 3:
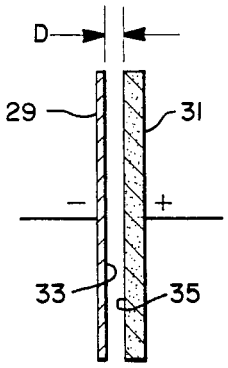
FIG. 3 is a schematic diagram, taken in cross section, depicting an electrode configuration according to a second embodiment of the invention.

An electrode configuration according to a second embodiment of the invention shall now be described with reference to FIG. 3. In this instance, a metal cathode 29 and a carbon-containing anode 31 are each of a substantially planar configuration. Cathode 29 includes an active surface 33 which is spaced from a corresponding opposed active surface 35 of anode 31. Surfaces 33 and 35 are also spaced from each other a distance D corresponding to the previously described spacing parameters.

Figure 4:
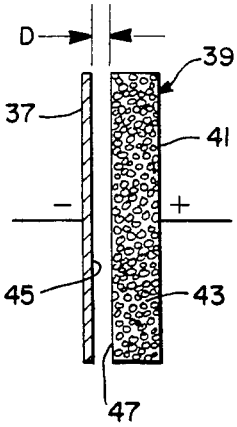
FIG. 4 is a schematic diagram, taken in cross section, depicting an electrode configuration according to a third embodiment of the invention.

An electrode configuration according to a third embodiment of the invention is shown in FIG. 4 and includes a cathode 37 having a planar configuration and a corresponding anode 39 in the form of a rectangular-shaped perforated metal container 41 filled with carbon or suitably prepared coal or biomass particles 43. Container 41 may be titanium or any other suitable metal known in the art for this purpose. It is also preferable that some means be provided for continually replenishing particles 43 as they are consumed during the gasification process. In this electrode configuration, cathode 37 includes an active surface 45 which is spaced from an opposed active surface 47 of anode 39 by the spacing designated distance D.

The aforedescribed electrode configurations are to be construed as merely preferred examples of any of a variety of configurations which may be deemed suitable for the practice of the invention. The anode may of course be formed of carbonaceous material, such as coal, coal chars, lignite, coke, carbon black, graphite, cellulose, wood, biomass or the like and combinations of same. The cathode is preferably of copper or any other metal deemed suitable for the reactions of the gasification or gasification and liquefaction process.

The aqueous electrolyte may preferably comprise a solution of sulfuric acid and water in varying ratios of concentration. A preferred concentration range would encompass those concentrations between 2.7 to 15 Normal $H_2SO_4$.

The gasification or gasification and liquefaction process may optimally be conducted within a temperature range of approximately 175° F. to 200° F., though preferably at 180° F. to 200° F. Conducting the process at a temperature in excess of the boiling point of the electrolyte would be possible provided the system is placed under an appropriate pressurized condition.

The electrical potential applied across the electrodes by a suitable direct current power source is preferably within the approximate range of 1.8 to 3.2 volts and a current density of approximately 1.0 to 12.0 amps per square inch. Due to the nature of the invention, the starting current density for initiating the electrochemical reaction may be approximately 10 amps per square inch and thereafter reduced to approximately 6 amps per square inch or less as an operating current density during the subsequent combined electrochemical and chemical reactions.

MODE OF OPERATION

In the operation of electrolytic cell system 1 according to the invention, an electrical potential is applied from power supply 17 across anode 5 and cathode 7 through conductors 19 and 21. Sufficient voltage is required to initiate the basic electrochemical reaction involving oxidation of carbon at the anode and reduction of water at the cathode, which reaction is expressed as follows:

$$H_2O+C \rightarrow H_2+CO$$

This reaction liberates oxides of carbon, specifically carbon monoxide, at the anode, while hydrogen gas is liberated at the cathode. The half cell reactions may be expressed as follows:

At the cathode:

$$2H^+ + 2e^- \rightarrow 2H^\circ$$

$$H^\circ + H^\circ \rightarrow H_2,$$

wherein H° is atomic hydrogen.

At the anode:

$$2O^= + 2C - 4e^- \rightarrow 2CO$$

It is important to note that H° is a product of the electrochemical reaction and is both highly reactive and of transient life. The H° is an activator species which causes a subsequent chemical reaction to occur in the system for simple carbon gasification as follows:

$$H_2O+C \rightarrow H_2+CO$$

which may be written in the form:

$$OH^- + H^+ + C \rightarrow H^\circ + H^\circ + CO,$$

and:

$$H^\circ + H^\circ \rightarrow H_2$$

This chemical reaction has been discovered to be self-sustaining, notwithstanding a reduction of the electrical potential required for initiating the aforementioned electrochemical reaction, while simultaneously generating an amount of gas far in excess of that normally realized through the electrochemical reaction alone. The chemical gasification reaction was found to be continuously self-sustaining under minimum electrical energy requirements until the reaction terminates due to depletion of the reaction components. Continual maintenance of the reaction can be realized through appropriate replenishing of water in the electrolyte and carbon in the anode, the two components consumed by the process.

The combined gasification and liquefaction process is more complex and involves hydrogenation and partial oxidation of the carbonaceous material. In addition to the above described reaction of carbon and water, a second type of reaction occurs wherein atomic hydrogen reacts with or activates certain points on large molecules to break them into smaller active molecules which subsequently exhibit the effects of hydrogenation or of hydrogenation and partial oxidation.

The new and unexpected results realized through the practice of the invention as disclosed herein can be attributed to several observations. The employment of an electrolyte containing a substantial concentration of an ion, for example $SO_4^=$, which is known as a "poison" or inhibitor for the reaction $H^\circ + H^\circ \rightarrow H_2$ serves to prolong the longevity of cathodically generated H° in the electrolyte and therefore renders same available for reaction activation. Moreover, the employment of a strong acid electrolyte which provides a high concentration of $H^+$ ion and a correspondingly low concentration of $OH^-$ ion constitutes a proper chemical environment for the desired reactions to proceed. It was further observed that control of the electrodes spacing distance D within a range of one and one-half inch or less, except in those instances wherein a hydride forming metal is included in the electrolyte to permit greater spacing distances, served to significantly increase the production of atomic hydrogen. When a hydride forming metal is utilized as an activator enhancement agent, the concentration of the metal in the electrolyte is within a range which yields a "spongy" or "mossy" nonadherent electrodeposit with high surface area for acceptance of hydrogen at the cathode and release of hydrogen as H° in the anode area as the metal hydride particles decompose to metal which is subsequently dissolved by the acid electrolyte, thereby releasing an additional supply of H° which activates the heretofore described chemical reactions.

The advantage of this system resides in the high output production of gas or gas and liquids with very low electrolysis energy requirements, thereby producing a gasification and liquefaction process that exceeds a strictly electrochemical process in efficiency by over 100%.

While the invention is operable without the use of activator enhancement agents, those agents increase the efficiency of the process and minimize the engineering problems in designing production type equipment. Nickel, cobalt, iron and copper are suitable for use as activator enhancement agents. These metals can be electrodeposited as sponge metal deposits, form unstable metal hydrides with electrochemically generated atomic hydrogen and, as metal particles after hydride decomposition, dissolve in the electrolyte to repeat the cycle as sponge metal deposits at the cathode. These metals can be used individually or in combination with each other. Nickel sulfate has been found to comprise an especially suitable compound for introducing a metal hydride forming agent to the electrolyte.

While the metal hydride is unstable at the temperature maintained in the cell and decomposes to metal particles and H° in a finite time in the body of the electrolyte, it becomes more unstable in the chemical atmosphere known as the "anode film" which surrounds the anode during electrolysis. Thus, while a certain portion of the metal hydride may release its H° in the body of the electrolyte, a major portion of the H° release occurs in the immediate vicinity of the carbonaceous anode where it becomes the activating agent for the chemical reaction between the carbonaceous material and water. In effect, the metal hydride functions as a carrier for transferring H° from the cathode film to the anode film in the electrochemical system.

The activator enhancement agent may be incorporated into the reaction in several ways. Preferably, an appropriate metalsalt may be introduced into the reactor as a minor constituent of the electrolyte. Alternatively, a small amount of the metal salt or free metal may be directly incorporated into the carbonaceous material making up the anode, in the form of particles or a thin wire, so that the agent is anodically dissolved and thereby metered into the electrolyte during the reaction. Also, a second electrochemical circuit may be provided with a metal suitable as an activator enhancement agent as the anode and with the cathode of the primary circuit serving as the common cathode for both circuits. The current in the second circuit is controlled to add the activator agent to the electrolyte as needed.

A suitable concentration of activator enhancement agent has been found to comprise approximately 100 grams $NiSO_4 \cdot 6H_2O$ per liter of electrolyte. The electrolyte may also be precharged by dissolving a nickel anode in solution to reach an equivalent $Ni^{+2}$ concentration.

As previously indicated, foaming often occurs during the gasification and liquefaction process, with the foam accumulating within the freeboard space above the surface of electrolyte 9 in chamber 3. This situation has been found to inhibit gas production. It has been discovered that minimizing or eliminating the accumulation of foam results in a significant increase in gas and liquid production. This is preferably accomplished by adding a defoaming agent to the electrolyte. Any suitable defoaming agent may be used for this purpose, but preferred agents are those containing parabens. In addition, small quantities of acetone and methylethylketone may be added to the agent to permit the latter to be easily dissolved in the electrolyte. A suitable concentration of a defoaming agent may comprise 8 ounces of the agent to each ½ gallon of electrolyte.

EXAMPLES

The invention shall now be described in further detail by way of several examples which were performed by operation of an electrolysis cell. The cell was defined by a one gallon glass jar provided with a screw type lid. The anode was in the form of a cylindrical carbon rod suspended from the lid and provided with an electrical lead extending therethrough. The cathode was also suspended from the lid and comprised of a copper sheet of ⅛ inch thickness and provided with an electrical lead. The anode and cathode were supported in such a manner that the spacing between their active surfaces could be adjusted from a maximum of 3 inches to a minimum of 1/16 inch. A direct current electrical power source with variable voltage control was connected to the electrical leads of the electrodes. The gas generated by the cell was conducted away by a tube sealed into a hole provided in the lid. The tube was connected to a gas conditioning and measuring train which included a gas scrubber-cooler, drying column and a gas measuring device. The active anode area was 12 square inches and the electrolyte volumes varied from about 1 to 1.3 liters in all examples.

EXAMPLE 1

The electrodes included a carbon anode and a copper cathode, and spaced a distance of 3 inches apart and the electrolyte composition was 2.7N $H_2SO_4$. The electrolyte temperature was maintained at 180° F. At a cell voltage of 2.4 volts, the cell amperage was observed to be 121 amps, and this resulted in a gas production of 3.2 cubic feet per hour or 0.026 cubic feet per ampere-hour.

As this example clearly illustrates, the results were typical of conventional electrolysis wherein the amount of gas produced per ampere-hour corresponds approximately to that predicted by application of Faraday's Law.

EXAMPLE 2

In this example, the carbon and copper electrodes were also spaced a distance of 3 inches apart, but the electrolyte composition was 5N $H_2SO_4$. An activator enhancement agent was added, which agent comprised $NiSO_4 \cdot 6H_2O$ in a concentration of 83 grams per liter. The electrolyte was maintained at a temperature of 200° F. Under these conditions, an application of 1.3 volts resulted in a cell amperage of 110 amps. This produced 7.0 cubic feet per hour of gas or 0.064 cubic feet per ampere-hour.

This example illustrates an application of the present invention wherein an activator enhancement agent in the form of nickel salt was added to the electrolyte, thus resulting in a volume of gas production which was several times greater than that predicted by application of Faraday's Law.

EXAMPLE 3

The carbon and copper electrodes were spaced 1/16 inch apart and the electrolyte composition was 5N $H_2SO_4$ maintained at a temperature of 180° F. An applied cell voltage of 2.6 volts resulted in a cell amperage of 128 amps. This produced a gas volume of 20 cubic feet per hour or 0.156 cubic feet per ampere-hour.

This example illustrates the effect of practicing the invention without the addition of an activator enhancement agent to the electrolyte. Under this condition, the electrodes were maintained at the close spacing of 1/16 inch, thereby permitting the transient activator agent H°, which is produced at the cathode, to activate the carbon anode. Thus, the gas production per ampere-hour was six times greater than that realized in Example 1 and over five times greater than that predicted by Faraday's Law.

EXAMPLE 4

In this example, the carbon anode to copper cathode spacing was also maintained at a distance of 1/16 inch and the electrolyte composition was 5N $H_2SO_4$ with added $NiSO_4 \cdot 6H_2O$ at a concentration of 83 grams per liter. The electrolyte temperature was 180° F. An applied cell voltage of 2.5 volts resulted in an observed cell amperage of 126 amps. This produced 25 cubic feet per hour of gas or 0.198 cubic feet per ampere-hour.

This example clearly illustrates that the gas production rate can be further enhanced when the electrodes are disposed at a close spacing from each other through the addition of a metal ion as an activator enhancement agent. The rate of gas production per ampere-hour was 7.6 times that observed in Example 1, and far greater than that expected by Faraday's Law. This example demonstrates that a large portion of the gas produced during the process was directly caused by the presence of a chemical reaction.

EXAMPLE 5

In this example, the carbon anode to copper cathode spacing was also maintained at a distance of 1/16 inch. The electrolyte composition was 5N $H_2SO_4$ with $NiSO_4 \cdot 6H_2O$ in a concentration of 83 grams per liter added to the electrolyte as the activator enhancement agent. In addition, 30 milliliters of an antifoaming agent was also added, which agent comprised the antifoaming composition sold under the trade name "Rug Doctor" for use in preventing foaming of carpet cleaning fluids. The electrolyte temperature was maintained at 200° F. and a constant cell voltage of 3.0 volts was applied. Observations and measurements were taken every 2 minutes after the expiration of the first minute and for a total of 6 minutes. It was noted that after 1 minute, the cell amperage was 110 amps and the gas volume production was 15 cubic feet per hour or 0.136 cubic feet per ampere-hour. After 2 minutes, the cell amperage was 100 amps and the gas production was 20 cubic feet per hour or 0.200 cubic feet per ampere-hour. After 4 minutes, the cell amperage was 96 amps and the gas production was 30 cubic feet per hour or 0.312 cubic feet per ampere-hour. After 6 minutes, the cell amperage was 95 amps and the gas production was 30 cubic feet per hour or 0.316 cubic feet per ampere-hour.

This example illustrates the increased efficiency with elapsed time of gas production when an antifoaming agent and activator enhancement agent are both present in the electrolyte. After an elapsed time of 6 minutes, the gas production rate per ampere-hour was 12.2 times that observed for Example 1. It is therefore apparent that the results derived from Examples 2–5 clearly establish the significant advantages made possible by the practice of the invention when compared to the results realized through practice of the prior art procedure demonstrated in Example 1.

The gas productions in the aforediscussed examples were only measured for volume on a dried basis as indicated, and not analyzed for composition. However, the gas productions in many other similar test runs with the same apparatus were analyzed and found to be principally comprised of hydrogen and carbon monoxide, along with small quantities of carbon dioxide and very small quantities of nitrogen.

EXAMPLE 6

In this example, three water cooled condensers were placed in series in the gas-vapor outlet line from the cell. Their position was between the cell and the previously described scrubber, dryer and gas measuring meter. The carbon anode to copper cathode spacing was maintained at a distance of 1/16 inch. The electrolyte composition was 5N $H_2SO_4$ with $NiSO_4 \cdot 6H_2O$ in a concentration of 83 grams per liter added to the electrolyte as the activator enhancement agent. No antifoaming agent was used. A wood chip mixture comprised of pine wood, bark and needles, collectively simulating pine wood waste, was mixed into the electrolyte so that the wood and bark particles were fully wetted by the electrolyte. The electrolyte temperature was maintained at 198° F. An applied cell voltage of 3.8 volts resulted in an observed cell amperage of 100 amps. The test duration was 1 hour and 20 minutes with a dry gas production of 6.2 cubic feet and a liquid production of 414 milliliters collected in the first condenser. No liquid was found in the second and third condensers. The liquid was analyzed and found to consist of the following by weight %:

Isopropyl alcohol: 22%
Isopropyl formate: 15%
Acetone: 11%
Acetic acid: 9%
Water: 37%
Undetermined or combined error in above quantities: 6%

Liquid from another, but identical, test run was tested for energy value in a calorimeter and was found to produce 7950 BTU per pound even though the water content was not removed.

The residue from the wood chips was removed from the cell at the end of the test run and washed and dried. It consisted of black porous material in the spatial form of the original chips and exhibited good electrical conductivity. The dried material was crushed to a fine powder. It was found to have the characteristics of activated carbon and appeared to be a relatively pure carbon with the high surface area required for activity characteristic of activated carbon.

This example illustrates that the process of the invention can produce unexpectedly large quantities of useful gases and liquids from wood wastes which are available in large quantities in many parts of the world. A form of activated carbon also results from the process.

EXAMPLE 7

In this example the apparatus, electrolyte composition and wood chip feed were exactly the same as in Eample 6. The electrolyte temperature was maintained at 198° F. The cell was not electrolyzed. A stream of gas collected from previous test runs identical to that of Example 6 was sparged through the cell electrolyte at the rate of 6.2 cubic feet over a period of 1 hour and 20 minutes. A small quantity of noncombustible liquid was collected in the condensers.

The residue from the wood chips was brown colored and otherwise unchanged from the original feed material. It could not be crushed into a powder by the procedure used in Example 6 and therefore did not warrant testing for possible use as activated carbon. The results of this test illustrate that electrolysis under the conditions which describe the invention is necessary to obtain the type and quantity of products which resulted from the operation of Example 6.

EXAMPLE 8

In this example, three water cooled condensers were also in place in the gas-vapor outlet line from the cell. The anode was cut from a slab of pitch bonded coal of the type commonly used for cell linings or electrodes in the aluminum industry. The anode to copper cathode spacing was 3/16 inch at the beginning of the test and had increased to ¾ inch at the completion of the test due to depletion of the anode material. The electrolyte temperature was maintained in the range from 196° F. to 200° F. An applied cell voltage of 2.8 volts resulted in an observed cell amperage of 100 amps. The test duration was 2 hours with a dry combustible gas production of 7.8 cubic feet and a total liquid production of 1066 milliliters in the three condensers, with approximately 75% in the first condenser, 20% in the second condenser and 5% in the third condenser.

The liquid was analyzed in all three condensers and found to consist of the following by weight %:

| | Condenser #1 | Condenser #2 | Condenser #3 |
|---|---|---|---|
| Water | 1.0% | 22.0% | 12.0% |
| Formic acid | — | 2.7% | 5.3% |
| Methanol | — | 1.0% | 1.5% |
| Ethanol | 7.5% | 57.6% | 44.3% |
| Methyl formate | 6.2% | 1.7% | 1.4% |
| Diethyl ether | 4.4% | 6.5% | 5.1% |
| Ethyl formate | 80.9% | 8.6% | 30.5% |

The liquid was combustible and tested for energy value in a calorimeter which showed a value of 8750 BTU per pound.

This example illustrates the use of the invention as a coal gasification and liquefaction method whereby a dirty burning solid fuel is converted to clean burning gas and liquid products. Liquids derived from coal through the practice of the invention are also useful as industrial chemicals.

It is to be understood that the embodiments and examples of the invention herein shown and described are to be taken as merely preferred embodiments of the same, and that various changes in the shapes, sizes, arrangement of parts, compositions, parameters and methods of use and operation may be resorted to, without departing from the spirit of the invention or scope of the subjoined claims.

I claim:

1. A process for the gasification or combined gasification and liquefaction of carbonaceous materials in an electrolytic cell including an anode and a cathode, the anode and cathode being immersed in an aqueous electrolyte and provided with a direct current power source, comprising the steps of:

(a) disposing a carbonaceous material in the electrolyte;

(b) spacing the electrodes from each other at a distance equal to or less than approximately one and one-half inches;

(c) applying an electrical potential of sufficient intensity across the electrodes for causing an electrochemical oxidation-reduction reaction wherein oxidation occurs at the anode and reduction of water occurs at the cathode to generate atomic hydrogen and produce hydrogen gas; and (d) utilizing the atomic hydrogen for activating a subsequent chemical oxidation-reduction reaction whereby gasification or combined gasification and liquefaction of the carbonaceous material is realized to produce a total amount of gaseous or combined gaseous and liquid product in excess of that normally realized only through electrochemical reaction in accordance with Faraday's Law for the amount of electrical energy consumed.

2. The process of claim 1 further including the step of adding an activator enhancement agent in the form of a hydride-forming metal or compound thereof to the electrolyte.

3. The process of claim 2 wherein the activator enhancement agent includes a metal or a salt of a metal selected from the group consisting of nickel, cobalt, copper and iron, or combinations thereof.

4. The process of claim 1 wherein the spacing between the electrodes is within the range of approximately 1/16 to ¼ inch.

5. The process of claim 1 further including the step of utilizing a consummable anode formed of carbonaceous material.

6. The process of claim 1 wherein the carbonaceous material is substantially entirely comprised of solid organic hydrocarbons.

7. The process of claim 1 including the step of adding a defoaming agent to the electrolyte in an amount sufficient to at least substantially reduce any foaming of the electrolyte.

8. The process of claim 7 wherein the defoaming agent includes parabens.

9. The process of claim 1 further including the step of maintaining the electrolyte at a temperature of from approximately 175° to 200° F.

10. The process of claim 1 wherein the intensity of the electric potential applied across the electrodes is from approximately 1.8 to 3.2 volts.

11. The process of claim 1 wherein the current density is from approximately 1.0 to 12.0 amps/inch$^2$.

12. The process of claim 1 wherein the aqueous electrolyte includes sulfuric acid in a concentration of from approximately 2.7 to 15.0N.

13. The process of claim 1 wherein the electrodes include a carbon anode and a metal cathode.

14. The process of claim 1 wherein:

(a) the electrochemical oxidation-reduction reaction is expressed as follows:

At the cathode:

$$2H^+ + 2e^- \rightarrow 2H^\circ$$

$$H^\circ + H^\circ \rightarrow H_2,$$

wherein $H^\circ$ is atomic hydrogen.

At the anode:

$$2O^= + 2C - 4e^- \rightarrow 2CO, \text{ and}$$

(b) the chemical oxidation-reduction reaction is expressed as follows:

$$OH^- + H^+ + C \rightarrow H^\circ + H^\circ + CO, \text{ and}$$

$$H^\circ + H^\circ \rightarrow H_2.$$

15. A process for the gasification of combined gasification and liquefaction of carbonaceous materials in an electrolytic cell including an anode and a cathode, the anode and cathode being immersed in an aqueous electrolyte and provided with a direct current power source, comprising the steps of:

(a) disposing a carbonaceous material in the electrolyte;

(b) adding an activator enhancement agent in the form of a hydride-forming metal or compound thereof to the electrolyte;

(c) applying an electrical potential of sufficient intensity across the electrodes for causing an electrochemical oxidation-reduction reaction wherein oxidation occurs at the anode and reduction of water occurs at the cathode to generate atomic hydrogen and produce hydrogen gas; and (d) utilizing the atomic hydrogen for activating subsequent chemical oxidation-reduction reaction whereby gasification or combined gasification and liquefaction of the carbonaceous material is realized to produce a total amount of gaseous or combined gaseous and liquid product in excess of that normally realized only through electrochemical reaction in accordance with Faraday's Law for the amount of electrical energy consumed.

16. The process of claim 15 wherein the activator enhancement agent includes a metal or salt of a metal selected from the group consisting of nickel, cobalt, copper and iron, or combinations thereof.

17. The process of claim 15 wherein the electrodes are spaced from each other at a distance equal to or less than approximately one and one-half inches.

18. The process of claim 17 wherein the spacing between the electrodes is within the range of approximately one-sixteenth to one-fourth inch.

19. The process of claim 15 further including the step of utilizing a consummable anode formed of carbonaceous material.

20. The process of claim 15 wherein the carbonaceous material is substantially entirely comprised of solid organic hydrocarbons.

21. The process of claim 15 including the step of adding a defoaming agent to the electrolyte in an amount sufficient to at least substantially reduce any foaming of the electrolyte.

22. The process of claim 21 wherein the defoaming agent includes parabens.

23. The process of claim 15 further including the step of maintaining the electrolyte at a temperature of from approximately 175° to 200° F.

24. The process of claim 15 wherein the intensity of the electric potential applied across the electrodes is from approximately 1.8 to 3.2 volts.

25. The process of claim 15 wherein the current density is from approximately 1.0 to 12.0 amps/inch$^2$.

26. The process of claim 15 wherein the aqueous electrolyte includes sulfuric acid in a concentration of from approximately 2.7 to 15.0N.

27. The process of claim 15 wherein the electrodes include a carbon anode and a metal cathode.

28. The process of claim 15 wherein:

(a) the electrochemical oxidation-reduction reaction is expressd as follows:

At the cathode:

$$2H^+ + 2e^- \rightarrow 2H^\circ$$

$$H^\circ + H^\circ \rightarrow H_2,$$

wherein H° is atomic hydrogen.

At the anode:

$$20^= + 2C - 4e^- \rightarrow 2CO, \text{ and}$$

(b) the chemical oxidation-reduction reaction is expressed as follows:

$$OH^{31} + H^+ + C \rightarrow H^\circ + H^\circ + CO,$$

and $$H^\circ + H^\circ \rightarrow H_2.$$

* * * * *